US005099249A

United States Patent [19]

Seavey

[11] Patent Number: 5,099,249

[45] Date of Patent: Mar. 24, 1992

[54] MICROSTRIP ANTENNA FOR VEHICULAR SATELLITE COMMUNICATIONS

[75] Inventor: John M. Seavey, Cohasset, Mass.

[73] Assignee: Seavey Engineering Associates, Inc., Cohasset, Mass.

[21] Appl. No.: 107,019

[22] Filed: Oct. 13, 1987

[51] Int. Cl.[5] ..... H01Q 1/38

[52] U.S. Cl. ..... 343/700 MS; 343/830

[58] Field of Search ..... 343/700 MS, 725, 829, 343/830, 846, 905

[56] References Cited

U.S. PATENT DOCUMENTS

| | | | |
|---|---|---|---|
| 4,089,003 | 5/1978 | Conroy | 343/846 |
| 4,218,682 | 8/1980 | Yu | 343/830 |
| 4,316,194 | 2/1982 | DeSantis et al. | 343/846 |
| 4,342,037 | 7/1982 | Dalby | 343/846 |
| 4,644,361 | 2/1987 | Yokoyama | 343/725 |

FOREIGN PATENT DOCUMENTS

| | | | |
|---|---|---|---|
| 93305 | 7/1980 | Japan | 343/700 MS |
| 160104 | 12/1981 | Japan | 343/700 MS |
| 107610 | 7/1982 | Japan | 343/700 MS |
| 2005922 | 4/1979 | United Kingdom | 343/700 MS |

*Primary Examiner*—Michael C. Wimer
*Attorney, Agent, or Firm*—Fish & Richardson

[57] ABSTRACT

A microstrip antenna includes an annular conducting element spaced by a dielectric element from a conducting ground plane and radiating circular polarization in a conical elevation pattern. A central whip antenna may be located on the axis of the annular-shaped element. Another microstrip antenna having an annular conducting element may be dielectrically spaced from the first-mentioned annular conducting element that comprises the ground plane for the second annular-conducting element.

2 Claims, 5 Drawing Sheets

MICROSTRIP ANTENNA FOR VEHICULAR SATELLITE COMMUNICATIONS

The present invention relates in general to electromagnetic transduction and more particularly concerns a novel microstrip antenna especially suitable for use on a vehicle roof for satellite communication and association with one or more other antennas for communicating over different frequency ranges.

There are available a number of satellites useful for navigation and communications accessible to vehicles on land, sea and air. One of the most difficult problems in taking advantage of these facilities is establishing efficient electromagnetic transduction between the vehicle and the space path between the vehicle and the satellite.

A search of the prior art uncovered U. S. Pat. Nos. 4,329,689, 4,379,296, 4,401,988 and 4,660,048, a book Marcuvitz, N., *WAVEGUIDE HANDBOOK* McGraw-Hill, 1951 Pages 77–80, an article IEEE Transactions on Antennas and Propagation Vol. AP32 No. 9 Sept. 1984 Pages 991–994, Huang, J. "Conical Patterns from Circular Microstrip Antennas" and an article IEEE Transactions on Antennas and Propagation Vol. AP25 No. 4 July, 1977 Pages 595–596 Shen, L. C. et al., "Resonant Frequencies of Circular Disk Printed Circuit Antenna."

It is an important object of this invention to provide an improved microstrip antenna system.

According to the invention, there is an annular flat metal conducting element spaced a short distance above a conducting ground plane, typically by a dielectric spacer, and fed preferably at a single point near its edge by a transmission line, such as a coaxial line rising from below the ground plane or a microstrip line in the plane of the annular conducting element. Preferably the antenna according to the invention is proportioned so that it radiates in a conical pattern in the elevation plane and omnidirectionally in azimuth with a radiation null on the central neutral axis.

The elevation pattern beamwidth and beam peak position may be established by selecting an appropriate $TM_{nl}$ mode where n is an integer greater than 1. For typical application in a mobile satellite communication system, the $TM_{21}$, $TM_{31}$ or $TM_{41}$ mode is suitable.

Preferably means are provided for slightly distorting the annulus to establish circular polarization, preferably by the addition of a small conducting protrusion at a unique position on the outside of the annular conducting element.

The radial location of the single feed point is preferably chosen to match the impedance level of the annular radiating element with that of the feeding transmission line, which is typically 50 ohms. For practical structures, the feed point is located near the outer diameter of the annular radiating element.

The central opening of the annular conducting element is preferably relatively small, typically 15% –25% of the outside diameter of the element and may be used to accommodate a whip-like antenna on the central axis or the addition of another similar microstrip antenna atop the original element for communication over other frequency ranges.

Numerous other features, objects and advantages of the invention will become apparent from the following specification when read in connection with the accompanying drawings in which.

Figure 1A:
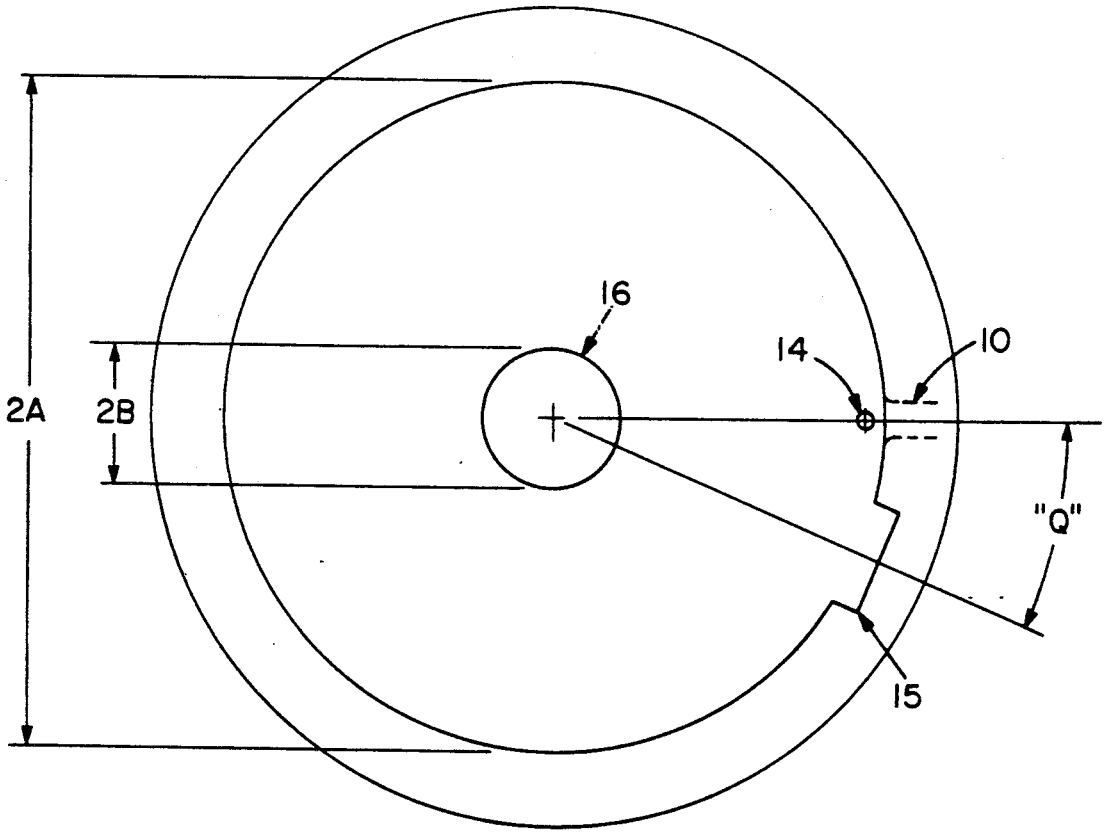
FIG. 1A is a plan view and FIG. 1B an elevation view of an embodiment of the invention.
Figure 1B:
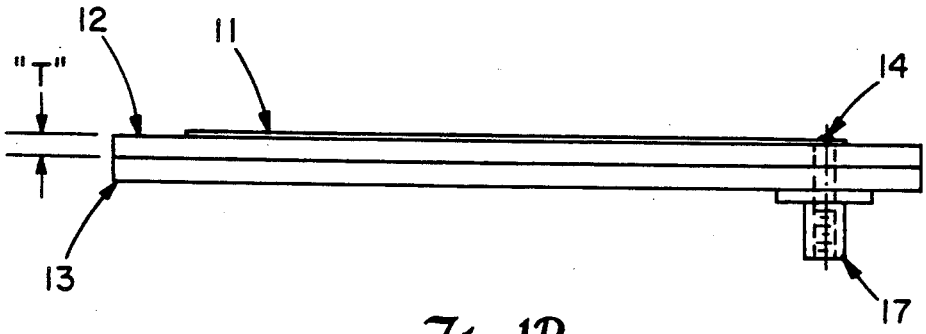

With reference now to the drawings and more particularly FIGS. 1A and 1B thereof, there are shown plan and elevation views, respectively, of an embodiment of the invention. The invention includes an annular element 11, typically a copper foil of thickness 0.001" to 0.003" thick and of outside diameter 2A resting on dielectric spacer 12, typically a teflon-fiberglass laminate having a dielectric constant of about 2.6 or polyphenylene oxide with a dielectric constant of about 2.5. Spacer 12 rests on ground plane 13, typically aluminum of $\frac{1}{8}$ thickness of diameter about 30%–40% greater than the diameter of element 11; that is, 2.6A–2.8A. Feed point 14 is connected to coaxial transmission line 17 extending below ground plane 13. Alternatively, feed point 14 may be connected to a microstrip line 20 shown in dotted outline in FIG. 1A.

Conducting element 11 is typically formed with a tab 15 outside the radius A and centered about a radius forming an angle Q with the radius passing through feed point 14. A typical angular span of tab 15 is 10°, and a typical radial width is 1.1A. This angular location determines the sense of circular polarization. With the location shown in FIG. 1A, the antenna is left-hand circularly polarized. The precise method of choosing the dimensions of the tab 15 is explained below; the intent is to change the impedance of the radiator in a preferred direction. Element 11 may be formed with a central opening 16 of diameter 2B. Opening 16 may or may not extend through dielectric spacer 12 depending on what additional antennas may be placed at this location.

Diameter 2A is chosen to correspond to the resonant frequency as explained below. The inner diameter 2B may be chosen over a wide range depending on the practical requirements of the design. Once established, inner diameter 2B and outer diameter 2A determine the operating (resonant) frequency. For inner diameters approaching the outer diameter, the mode analysis shown below still applies. In practical cases where the center hole is used to install a coaxial transmission line, or a whip antenna, the ratio of B to A may be in the order of 0.25.

Figure 2:
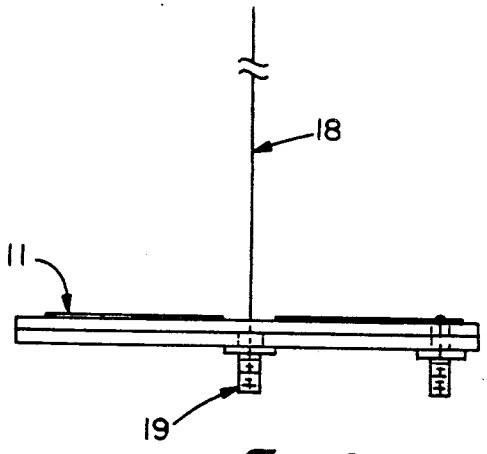
FIG. 2 is an elevation view of the embodiment of FIG. 1B also carrying a whip antenna.

Referring to FIG. 2, there is shown an elevation view of the antenna of FIGS. 1A and 1B in combination with a whip antenna 18 fed through coaxial connector 19.

Figure 3:
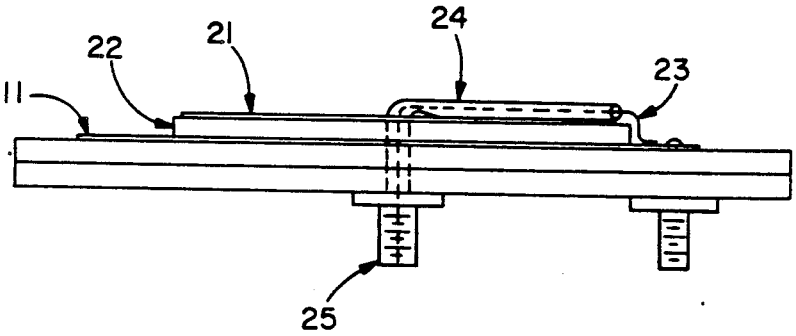
FIG. 3 is an elevation view of the embodiment of FIG. 1B carrying a second embodiment of the invention of smaller diameter for operation over a second frequency range.

Referring to FIG. 3, there is shown an elevation view of the embodiment of FIG. 1 with a second microstrip antenna having an annular conducting element in accordance with the invention. This upper antenna includes annular conducting element 21 spaced from annular conducting element 11 by upper dielectric spacer 22, which may be made of the same material as lower dielectric spacer 13. This upper antenna may be fed by coaxial line 24 along the common axis of both antennas through central opening 16 of the lower antenna and a similar central opening in the upper antenna rising from coaxial connector 25. The outer conductor of coaxial line 14 is connected to ground plane 13, contacts the second annular element 21 as shown and is bent in a radial direction that runs from the center line of the antennas to the outside of the second annular conducting element 21 At the feed point 23 of the second annular conducting element 21, coaxial transmission line 24 has its inner conductor connected to the lower annular conducting element 11. This arrangement feeds the upper antenna at the correct radius for impedance matching.

The radius on the upper antenna at which the inner conductor is connected to the lower element is established by the same requirement for impedance matching as for the lower element.

The upper element tab is also chosen with the same principles in mind as for the lower element; the difference being in the choice of a higher frequency of operation of the (smaller) upper element.

Figure 4:
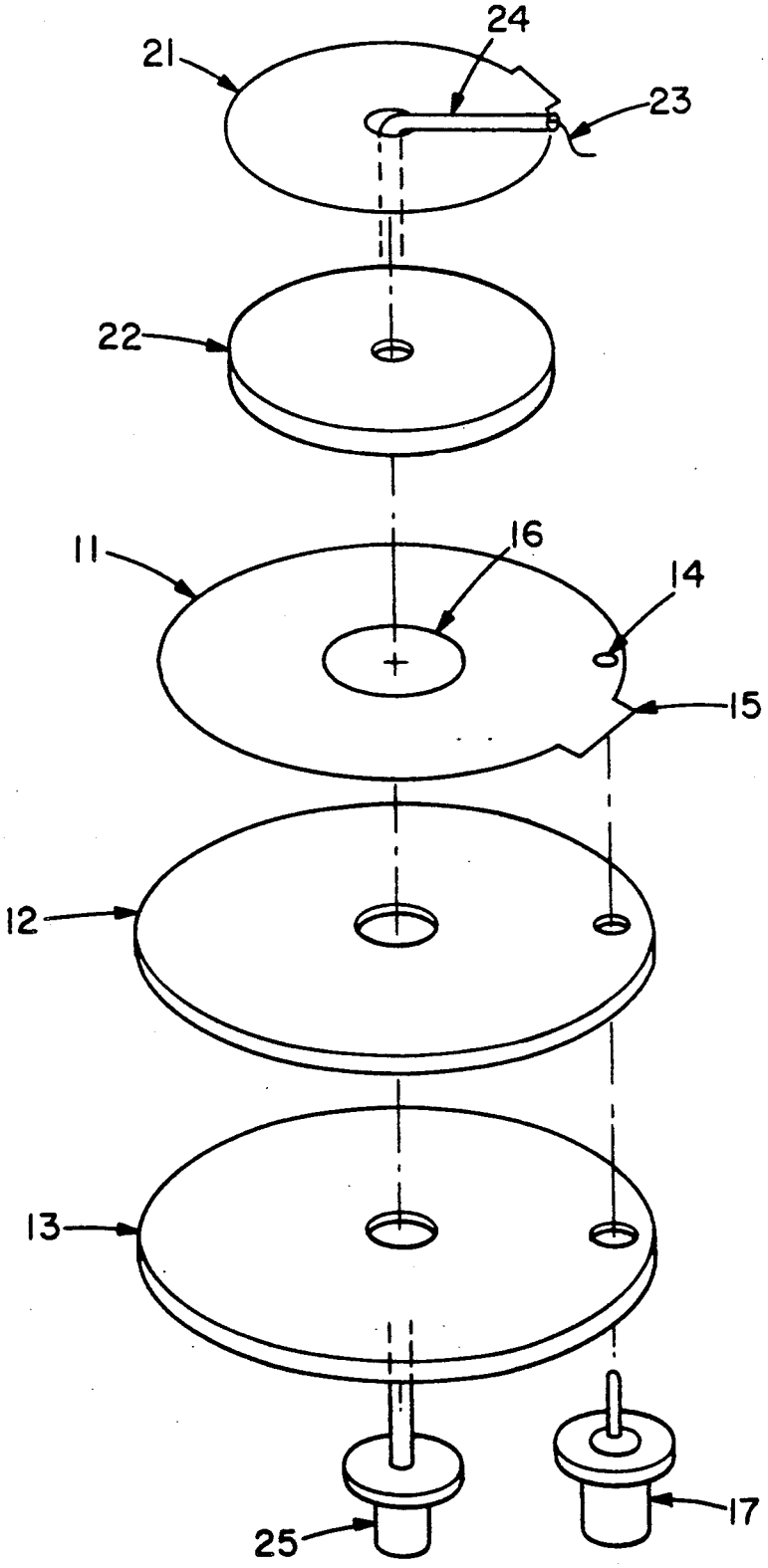
FIG. 4 is an exploded view of the embodiment of FIG. 3.

Referring to FIG. 4, there is shown an exploded view of the embodiment of FIG. 3.

Having described structures according to the invention, it is now appropriate to consider principles of operation. The Marcuvitz WAVEGUIDE HANDBOOK and Shen article cited above are helpful in calculating the resonant frequency of the annulus microstrip antenna. The resonant frequency may be calculated from the following expressions:

$$f = \frac{11.8\, X_{n1}}{2\pi \sqrt{e}\; a \sqrt{1+p}}$$

and $$p = \frac{2t}{\pi a e}\left(\ln\left(\frac{\pi a}{2t}\right) + 1.7726\right)$$

where the following definitions apply (see FIG. 1A):

| | | |
|---|---|---|
| $2a$ | = | outer diameter of annulus |
| $2b$ | = | inner diameter of annulus |
| $t$ | = | thickness of dielectric spacer |
| $e$ | = | dielectric constant of spacer |
| $f$ | = | resonance frequency (GHz) |
| $X_{n1}$ | = | first root of the derivative of the Bessel-Neumann combination function of order "$n$", |

and

| | | |
|---|---|---|
| $X_{11}$ | = | 1.644 |
| $X_{21}$ | = | 3.008 |
| $X_{31}$ | = | 4.192 |
| $X_{41}$ | = | 5.311 |
| $X_{51}$ | = | 6.412 |

(for a Value of b/a =0.25)

The radiation patterns are omnidirectional in the azimuth plane.

In the elevation plane, the elevation patterns are given by:

$$P(\theta) = A^2 + B^2$$

where $$A = \cos(\theta)[J_{m+1}(y) + J_{m-1}(y)]$$
$$B = J_{m+1}(y) - J_{m-1}(y)$$
$$y = \frac{2\pi a}{\lambda}\sin(\theta)$$

and where

| | | |
|---|---|---|
| $J_m$ | = | Bessel Function of First Kind of Order "$m$" |
| $\theta$ | = | zenith angle |
| $\phi$ | = | azimuth angle |
| $P(\theta)$ | = | relative power radiated in elevation plane. |

Figure 5:
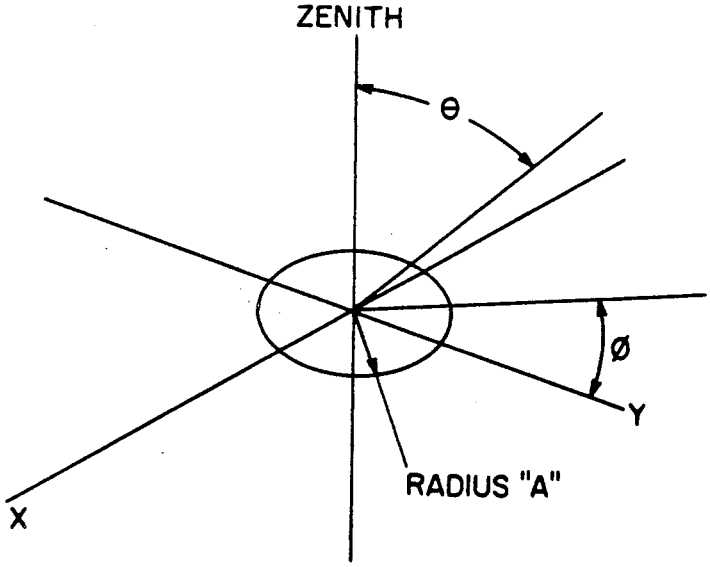
FIG. 5 illustrates a spherical coordinate system for defining the angles $\theta$ and $\phi$ for radiation pattern analysis.

Typical radiation patterns derived from these expressions are plotted in FIG. 5 for e =2.6.

These patterns illustrate the usefulness of the subject antenna in a mobile geostationary satellite communications system in which the satellite may appear at any azimuth and at an elevation angle typically 10° to 75° above the horizon.

Figure 6:
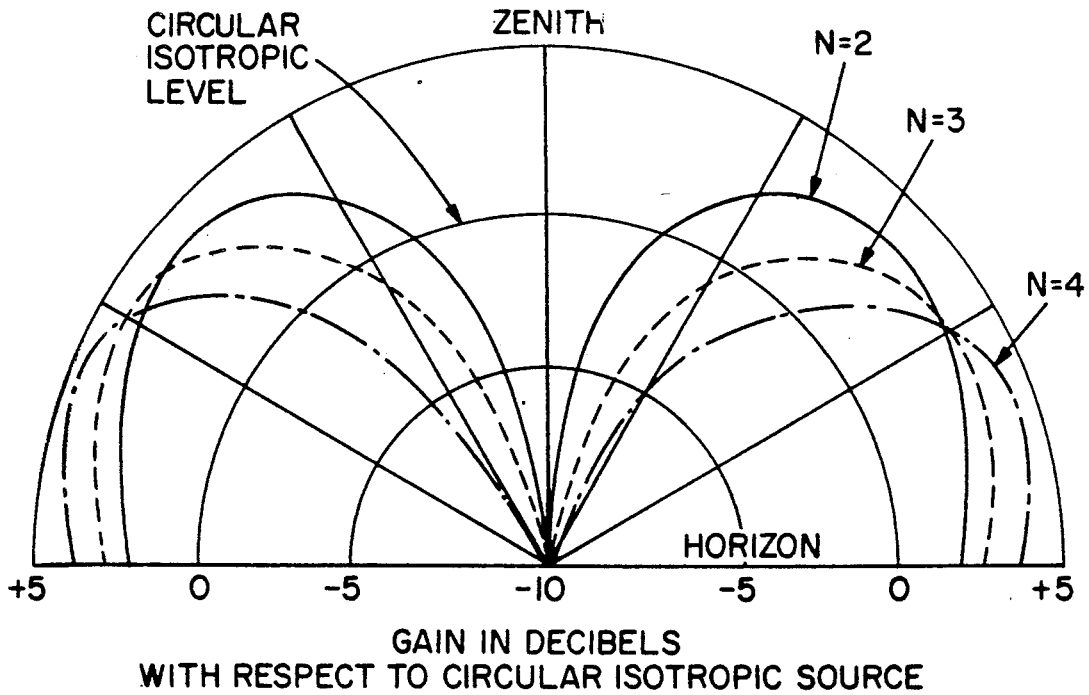
FIG. 6 shows the calculated radiation patterns in the elevation plane for the indicated radiation modes.

Referring to FIG. 5, there is shown the spherical coordinate system defining the angles $\theta$ and $\phi$ for radiation pattern analysis. FIG. 6 shows the calculated radiation patterns in the elevation plane for the different radiation modes for n =2, 3 and 4.

Figure 7:
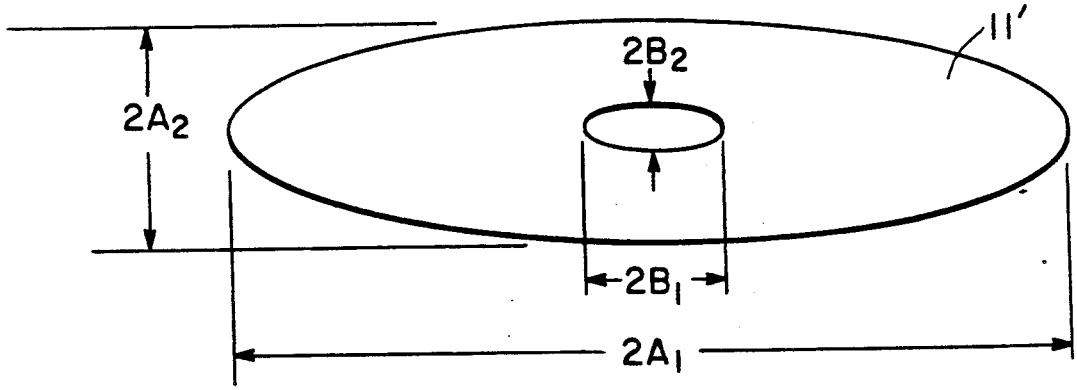
FIG. 7 is a perspective diagrammatic view of an elliptical annular conducting element.

Referring to FIG. 7, there is shown a perspective diagrammatic view of an elliptical annular conducting element 11' having a major axis width of $2A_1$ and a minor axis width of $2A_2$ formed with an elliptical opening having a major axis width of $2B_1$ and a minor axis width of $2B_2$.

Figure 8:
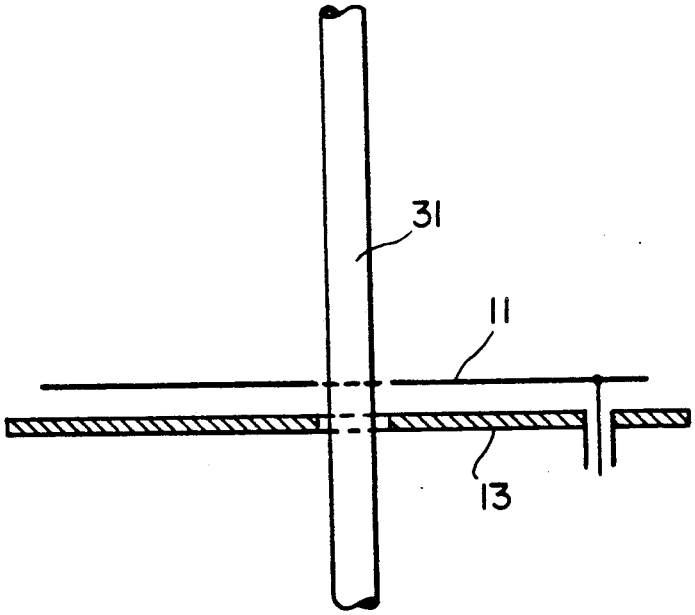
FIG. 8 is a fragmentary elevation view showing a central slender conducting cylinder connected to the ground plane.

Referring to FIG. 8, there is shown perspective diagrammatic view showing a central slender conducting cylinder 31 connected to conducting ground plane 13.

The following is a summary of the radiation characteristics in the elevation plane of the FIG. antenna from the FIG. 5 illustration. The dielectric constant of the spacer is e =2.6.

TABLE I

CALCULATED ELEVATION RADIATION CHARACTERISTICS

| Mode | Diameter Wavelengths 2A/ | Beam Peak Angle max | Halfpower Beamwidth · HP | Peak Directivity dBic |
|---|---|---|---|---|
| $TM_{21}$ | 0.57 | 48° | 68° | 4.0 |
| $TM_{31}$ | 0.81 | 62° | 54° | 4.1 |
| $TM_{41}$ | 1.02 | 70° | 43° | 4.6 |

All of above radiation pattern calculations assume that the antenna is placed on an infinite ground plane.

It can be seen from these illustrative calculations that a practical satellite antenna for a mobile platform will find the $TM_{21}$ mode most useful.

Circular polarization is excited in the annular element by perturbing the generally circular shape in accordance with well-known procedures (see the above-cited Shen paper for example). The technique is to render the circular diameter slightly assymetrical by any of various means such as making the circle elliptical, cutting an assymetrically-shaped hole in the element, or by the addition of external protruberances. In this invention, the preferred method is to add a small conducting "tab" to the outside of the element and at an angular distance "Q" from the feed radius where $$Q = \frac{45°}{n}$$

When this is done, the current from the feed point is divided into two modes within the element. These have phase quadrature and, at the resonance frequency, are equal in amplitude. With these conditions, circular polarization is radiated with a sense depending on the direction of the angle "Q".

The ellipticity ratio of circular polarization is minimum for values of 0 up to about 60° at which point it increases because one of the current modes cannot propagate across the metal ground plane. With small diameter ground planes, this effect can be minimized, however.

It has been found best to adjust the frequency of perfect circular polarization experimentally by properly choosing the length of the radial width of the "tab".

With these techniques it has been determined that the frequency bandwidth within which the ellipticity ratio is better than 2 dB is about 1.5%.

The following examples were actually constructed and exhibited the electrical performance indicated.

TABLE II

| LOWER ANNULAR ELEMENT PREFORMANCE | |
|---|---|
| Physical Parameters: | |
| Outer diameter | 2a = 4.3" |
| Inner diameter | 2b = 1.0" |
| Spacer thickness | t = 0.125" |
| Spacer material: | polyphenylene oxide |
| Ground plane diameter = | 6" |
| Electrical Performance | |
| Frequency at Resonance | 1.618 GHz |
| Bandwidth | 25 MHz |
| Polarization sense | LHCP |
| Mode | $TM_{21}$ |
| Peak Gain, dBic | 4.4 |
| Ellipticity Ratio | 2 dB, maximum from $\theta$ = 20° to 75° |
| VSWR | 1.5, maximum |

With the example set forth in Table II, a whip antenna 18 was added to form the embodiment of FIG. 2. The whip was terminated in a standard BNC coaxial connector 19 and consisted of a stainless steel wire about 1/16" diameter and 11" in length having an electrical length approximately half its physical height. This whip antenna 18 functioned as a Loran C receiving antenna in a navigation system, or as an AM/FM receiving antenna in a vehicular installation with the microstrip antenna according to the invention functioning for satellite communications.

TABLE III

| TOP ANNULAR ELEMENT PERFORMANCE | |
|---|---|
| Physical parameters | |
| Outer diameter = | 2.80" |
| Inner diameter = | 0.5" |
| Spacer thickness = | 0.125" |
| Spacer material | Polyphenylene oxide |
| Electrical Performance | |
| Frequency at resonance | 2.49 GHz |
| Bandwidth | 20 MHz |
| Polarization sense | RHCP |

TABLE III-continued

| TOP ANNULAR ELEMENT PERFORMANCE | |
|---|---|
| Mode | $TM_{21}$ |
| Peak gain, dBic | 3.3 |
| Ellipticity ratio | 2 dB, maximum from $\theta$ = 20° to 75° |
| Isolation - lower to upper element | 35 dB minimum |
| VSWR | 1.5, maximum |

The second example identified in Table III was placed on the example in Table I to form the embodiment of FIGS. 3 and 4.

The specific embodiments described herein are examples only of the many possible combinations of frequency bands, polarization senses, radiation modes and choices of topmost antenna types. Other combinations are within the scope of the invention using different dielectric constants of the spacer materials.

A feature of the invention is that the neutral axis of the annular disk antenna allows any slender and/or symmetrical second antenna to be located along or about this neutral axis. For example, a second $TM_{11}$-mode microstrip antenna of either linear or circular polarization may be placed on the embodiment of FIG. 1 to radiate a broad beam pattern in the $\theta=0°$ direction. Still another modification allows the antenna of FIG. 1 to be supported around a conducting mast of a tower or upright metal post, an especially advantageous feature for use on shipboard and at other locations where support masts are conveniently available.

The invention includes a number of features. It provides a single feed point on an annular element. It may provide circular polarization. It may be characterized by a conical radiation pattern of several elevation shapes. A central hole on the neutral axis is convenient for mounting on a mast or accommodating another antenna, such as a monopole antenna. The structure is compact in height and diameter. In combination with a whip-like monopole antenna on its axis, the antenna system thus formed allows for simultaneous functioning as an omnidirectional antenna for satellite communications and for low frequency broadcast (AM and FM) signals; or for position determination in connection with Loran C or Omega transmitters. In combination with a similar annulus microstrip antenna mounted atop a first radiating element, the system thus formed may provide simultaneous transmission and reception of satellite signals at different frequencies and/or polarization senses.

The invention has numerous applications in communications and positioning determination systems using geostationary satellites and a set of mobile platforms (vehicles, railroad trains, man-packed equipment) or fixed stations. In these systems, the conical radiation pattern provides omnidirectional coverage to the satellite for most geographic locations.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A microstrip antenna comprising, (a) a conducting element of generally annular shape about its axis and formed with an opening through which said axis passes.

(b) a conducting ground plane, (c) dielectric material separating said conducting element and said conducting ground plane, (d) a single feed point on said conducting element for exciting currents on said element, (e) said conducting element having means for establishing a certain asymmetry for exciting circular polarization, (f) said conducting element, conducting around plane and dielectric material dimensioned and coacting to establish propagation of transverse-magnetic $TM_{nl}$ mode currents within the microstrip antenna, where "n" is an integer greater than numeral 1 to establish radiation of circular polarization in a conical elevation radiation pattern with a radiation null on said axis, a second microstrip antenna comprising, (a) a second conducting element of generally annular shape about said axis and formed with an opening through which said axis passes, (b) a second conducting ground plane, (c) dielectric material separating said second conducting element and said second conducting ground plane, (d) a single feed point on said second conducting element for exciting currents on said second conducting element, (e) said second conducting element having means for establishing a certain asymmetry for exciting circular polarization, (f) said second conducting element, second conducting ground plane and the dielectric material separating said second conducting element and said second conducting ground plane dimensioned and coacting to establish propagation of transverse-magnetic $TM_{nl}$ mode currents within the microstrip antenna, where "n" is an integer greater than numeral 1 to establish radiation of circular polarization in a conical elevation radiation pattern with a radiation null on said axis, said first and second conducting elements being coaxial about and axially displaced along said axis, a coaxial transmission line extending first along said axis, then bending and running radially atop said second microstrip antenna and having an inner conductor contacting the first-mentioned microstrip antenna.

2. A first-mentioned microstrip antenna and second microstrip antenna in accordance with claim 1 wherein said first-mentioned microstrip antenna and said second microstrip antenna include means for operating in the same radiating mode.

* * * * *